US007434401B2

(12) United States Patent
Hayashi

(10) Patent No.: US 7,434,401 B2
(45) Date of Patent: Oct. 14, 2008

(54) FUEL/AIR PREMIXER FOR GAS TURBINE COMBUSTOR

(75) Inventor: Shigeru Hayashi, Tokyo (JP)

(73) Assignee: Japan Aerospace Exploration Agency, Tokyo (JP)

( * ) Notice: Subject to any disclaimer, the term of this patent is extended or adjusted under 35 U.S.C. 154(b) by 900 days.

(21) Appl. No.: 10/909,412

(22) Filed: Aug. 3, 2004

(65) Prior Publication Data

US 2005/0039456 A1 Feb. 24, 2005

(30) Foreign Application Priority Data

Aug. 5, 2003 (JP) ..... 2003-287028

(51) Int. Cl.
*F02C 1/00* (2006.01)

(52) U.S. Cl. ..... 60/743; 60/748

(58) Field of Classification Search ..... 60/743, 60/737, 748, 742, 740; 239/404, 403, 406
See application file for complete search history.

(56) References Cited

U.S. PATENT DOCUMENTS 3,028,102 A * 4/1962 Davies et al. ..... 239/404
3,254,846 A * 6/1966 Schreter et al. ..... 239/400
3,713,588 A * 1/1973 Sharpe ..... 239/400
3,912,164 A * 10/1975 Lefebvre et al. ..... 239/5
3,917,173 A * 11/1975 Singh ..... 239/400
5,165,241 A 11/1992 Joshi et al.
5,782,626 A * 7/1998 Joos et al. ..... 431/8
6,786,430 B2 * 9/2004 Hayashi ..... 239/406
2003/0141383 A1 * 7/2003 Hayashi ..... 239/406

FOREIGN PATENT DOCUMENTS

EP 0 660 038 A3 6/1996
EP 1 036 988 9/2000
JP 9-119639 5/1997

* cited by examiner

*Primary Examiner*—Devon Kramer
*Assistant Examiner*—Vikansha Dwivedi
(74) *Attorney, Agent, or Firm*—Westerman, Hattori, Daniels & Adrian, LLP.

(57) ABSTRACT

A fuel/air premixer for use in a gas turbine improves the atomization performance and mixing performance of the fuel by guiding an air so as to flow in an outward radial direction. A flow-deflecting tubular body having an annular cross section is disposed on the inside of and coaxially with a liquid film-forming body of an airbiast atomizer nozzle disposed at the inlet portion of a premixing tube. The outer peripheral surface of the flow-deflecting tubular body has a wall surface which increases in outer diameter toward the tip end of a first annular passage. The inner peripheral surface of the flow-deflecting tubular body has a form in which the inner diameter has a minimum to form a contracted portion, and then increases dramatically toward the tip end.

9 Claims, 7 Drawing Sheets

FUEL/AIR PREMIXER FOR GAS TURBINE COMBUSTOR

BACKGROUND OF THE INVENTION

1. Field of the Invention

The present invention relates to a fuel/air premixer used in a premixed, prevaporized-type combustor of a gas turbine which uses liquid fuel, and more particularly to a fuel/air premixer for a gas turbine combustor having at least one airblast atomizer nozzle comprising a liquid film-forming body disposed at an inlet portion of a premixing tube.

2. Description of the Prior Art

The nitrogen oxide NOx (NO and $NO_2$) that is discharged from various combustion devices is not only harmful to the human body, but is also a cause of acid rain and the greenhouse effect, and as a result has become subject to official emission controls in industrialized nations. Gas turbines are no exception to these controls, and NOx emission standards are provided for gas turbines on national and local levels for industrial use, and on an international level for aircraft use. These emission standards appear likely to be strengthened in the future. Meanwhile, gas turbines are being operated at increasingly high operating temperatures and pressures in order to improve fuel economy, thereby promoting NOx formation. As a result, demands are being made for the practical application of low NOx combustion technology which is able to suppress the formation of NOx effectively.

As a whole, gas turbine combustors perform excess air lean premixed combustion. A feature of this combustion method is that a lean pre-mixture with a high degree of homogeneity, which is formed by mixing fuel with excess air prior to combustion, is burned. Here, "lean" refers to a state in which, according to a minimum air amount required for complete combustion of the fuel as a reference, the air amount is sufficiently large. Depending on the gas turbine type and so on, approximately double the minimum air amount is used, and hence excess air lean premixed combustion is an extremely useful method of suppressing NOx emissions. The formation rate of NOx increases exponentially in relation to the combustion gas temperature, and hence when homogeneity is low, NOx increases in the pockets having higher fuel concentrations than average far outweigh NOx reductions in the pockets having lower fuel concentrations. As the homogeneity decreases, this excess increases. Premixing is a method of increasing the homogeneity of the air/fuel mixture.

Lean premixed combustion type combustors have come into wide use, mainly in natural gas large-scale power generation gas turbines. In response, high expectations have been placed on the practical application of lean premixed combustion to liquid fuel gas turbines and aircraft gas turbines, but this is still in the development stage. The technical aspect to this is that it is far more difficult to form a pre-mixture with a high degree of homogeneity when using liquid fuel than when using gaseous fuel.

When liquid fuel is used, first the fuel is atomized, and then the generated particles are dispersed spatially by an air stream. Vaporization of the fuel particles progresses in the dispersion process, and once the fuel vapor has undergone a process of diffusion into the air, a pre-mixture is formed. Hence in the case of liquid fuel, this process is referred to specifically as lean premixed prevaporized combustion. When the temperature and pressure of the air are high, a chemical reaction may occur in the aforementioned process, possibly leading to auto-ignition. If, as a result of this auto-ignition, a flame is formed within the premixing tube and held within the interior of the tube, the premixing tube, fuel atomizer nozzle, and so on are damaged by burning. Kerosene and jet fuel contain components which decompose at comparatively low temperatures, and hence auto-ignite at lower temperatures than natural gas, which has methane as its main component. Auto-ignition does not occur immediately after the fuel is injected into the air stream, but after a certain delay. This delay shortens dramatically as the temperature and pressure rise, and enters the order of one millisecond under the inlet temperature/pressure conditions of the latest high pressure ratio gas turbine combustors.

Fuel atomization must be advanced if the injected fuel is to substantially complete vaporization within a short time. Further, the fuel particles must be dispersed over the entire cross section of the premixing tube as quickly as possible to achieve an even fuel concentration over the cross section of the premixing tube. When fuel particle dispersal is insufficient, the fuel concentration distribution remains uneven over the cross section of the premixing tube outlet even if the fuel particles are completely vaporized. It is particularly difficult to avoid this unevenness when the diameter of the premixing tube is large. Forming an air stream which spreads in the radial direction of the premixing tube is effective in the dispersal of the fuel particles. Forming a swirl within the premixing tube is also effective in transporting the fuel particles in a radial direction, and is of course also highly effective in advancing the vaporization of the fuel particles and the turbulent diffusion and mixing of the fuel vapor. However, a problem which arises when forming a swirl within the premixing tube is that regions with a low velocity are typically formed in the vicinity of the central axis such that when the swirl is strong, a back flow is formed. This increases the likelihood of so-called backfiring, in which a flame runs up through these regions within the premixing tube from the combustion chamber.

Known conventional gas turbine fuel/air premixers for use with liquid fuel include a premixer in which fuel is atomized at an inlet portion of a premixing tube taking the form of a venturi tube, and then mixed with air that is introduced into the venturi tube (for example, Japanese Unexamined Patent Application 2000-304260), and a premixer in which fuel is injected from a hole formed in the wall surface of the contracted portion of a venturi tube, whereupon the fuel is atomized by an air stream therein. FIG. 6 shows a representative aspect of the fuel/air premixer for a small gas turbine disclosed in Japanese Unexamined Patent Application 2000-304260. Fuel is atomized by a pressure swirl nozzle 69 upstream of an inlet 66*a* to a premixing tube 16. The atomized fuel particles are dispersed into an air stream 63 flowing into the premixing tube 16, whereupon a mixture 64 of the fuel particles and air passes through a contracted portion 66*b* of the premixing tube 16 and flows into a combustion chamber 65 while being reduced in speed at an enlarged portion 66*c* of the premixing tube 16. In this example, the premixing tube 16 widens substantially linearly downstream of the contracted portion 66*b*.

In a fuel/air premixer such as that described above, fuel is atomized at or upstream of the contracted portion in order to facilitate dispersion of the fuel particles into the air stream. The dispersed fuel particles are carried downstream on the air stream while being vaporized, whereupon the fuel vapor mixes with the air to form a pre-mixture. If the enlarged portion expands excessively downstream of the contracted portion, the flow peels away from the wall surface, forming a back flow region, and hence the angle of expansion must be suppressed to no more than several degrees. If, in a premixing tube taking the form of a venturi tube, the air stream is caused to swirl in order to promote dispersion of the fuel particles and mixing of the fuel vapor and air, a back flow region is formed on the central axis of the enlarged portion, increasing the likelihood of backfiring. Hence a venturi tube form cannot be applied to a premixer with a large passage cross section. This problem can be solved by bundling together a large number of prevaporizing tubes with small passage cross sections, but this solution leads to further problems such as complication of the fuel supply system, weight increases, and so on.

Fuel/air premixers for gas turbine combustors in which an air swirler is disposed at the inlet portion to the premixing tube such that the air is caused to swirl, thereby promoting mixture with the fuel, are used widely in gaseous fuel gas turbine combustors (for example, Japanese Unexamined Patent Application H9-119639). These premixers may be applied to liquid gas turbine combustors simply by replacing the fuel nozzle with a liquid fuel nozzle (for example, Japanese Unexamined Patent Application H5-87340). FIG. 7 shows a representative example thereof, in which an air swirler 74 is disposed at an inlet 73 to the premixing tube 16, a central body 77 is disposed on the central axis of the premixing tube 16, and fuel is injected from fuel injection holes 78 on the surface of the central body 77. The central body 77 extends to the vicinity of the outlet of the premixing tube 16. As noted above, this form has the advantage of promoting dispersion and vaporization of the fuel particles, and diffusion and mixing of the fuel vapor, by means of a swirl, but is disadvantaged in that a low velocity region is formed in the central portion of the premixing tube 16. Since fuel also exists in this part, backfiring is likely to occur.

In this example, to solve the problems described above, the central body is provided on the central axis such that the cross-section of the pre-mixture passage takes an annular form, thereby decreasing the likelihood of a back flow while still applying a swirl. The problem with this type of fuel/air premixer for a gas turbine combustor is that a flame is formed at the outlet of the premixing tube, and hence the tip end portion of the central body is heated excessively by the flame and radiation from the flame. If the tip end of the central body is positioned upstream of the premixing tube outlet in an effort to suppress such excessive heat, the end of the back flow region, which had been positioned downstream of the premixing tube outlet, moves within the premixing tube, and hence the vicinity of the premixing tube outlet may be heated excessively. Moreover, the very existence of the central body wastes space and increases weight, and since the central body is supported by vanes of the air swirler attached to the inlet portion of the premixing tube, thus forming a so-called cantilever structure, there is a danger of the central body falling off due to combustion vibration or the like. Note that a form in which the air swirler at the inlet portion of the annular passage is constituted by coaxial inner and outer air swirlers, and back flows are prevented by having the two air swirlers rotate in opposite directions, is disclosed in Japanese Unexamined Patent Application H5-87340, for example.

Hence, when fuel from the tip end of a liquid film-forming body is atomized by an air stream and mixed with air in a fuel/air premixer for a gas turbine combustor, the air stream flow must be used to prevent back flows inside the premixing tube and reductions in the velocity of the mixture in a central portion of the premixing tube, and to take measures against backfiring caused by abnormal reductions in the air velocity and so on. These problems are to be solved using air stream swirling means which increase the velocity of the air stream passing through the inside of the liquid film-forming body and form a flow which spreads outward in the radial direction, thereby improving the atomization performance and mixing performance of the fuel, and thus forming a favorable mixture.

SUMMARY OF THE INVENTION

An object of the present invention is to provide a novel fuel/air premixer for a gas turbine combustor wherein an airblast atomizer nozzle comprising a liquid film-forming body, in which a conventional tubular inner surface serves as a fuel liquid film-forming surface, is disposed at an inlet portion to a premixing tube as fuel atomizing means. When fuel from a tip end of the liquid film-forming body is atomized by an air stream and mixed with air, air stream swirling means which are effective in forming a favorable mixture are used to increase the velocity of the air stream passing through the inside of the liquid film-forming body and form a flow which spreads outward in a radial direction, thereby improving the atomization performance and mixing performance such that both complete combustion and very low NOx combustion can be achieved easily. As a result, back flows within the premixing tube and reductions in the mixture velocity in a central portion of the premixing tube are suppressed, burning damage to components such as the premixing tube is prevented in cases of backfiring caused by abnormal decreases in the air stream velocity and so on, and when the air velocity recovers, the flame which backfired is immediately discharged downstream from the premixing tube.

The present invention has been designed in order to solve the problems designed above, and hence a fuel/air premixer for a gas turbine combustor according to the present invention is constituted by disposing an airblast atomizer nozzle comprising a liquid film-forming body, a tubular inner surface of which serves as a fuel liquid film-forming surface, at an inlet portion to a tubular premixing tube as fuel atomizing means, disposing a flow-deflecting tubular body having an annular cross section on the inside of and coaxially with the liquid film-forming body, disposing a first air swirler in an upstream portion of an annular passage formed between an outer peripheral surface of the flow-deflecting tubular body and the liquid film-forming surface of the liquid film-forming body, and disposing a second air swirler in an upstream portion of a passage which comprises as a wall surface an inner peripheral surface of the flow-deflecting tubular body. The flow-deflecting tubular body takes a form in which an outer diameter defining the outer peripheral surface thereof increases toward a tip end of the annular passage, and an inner diameter defining the inner peripheral surface thereof has a minimum downstream of a downstream end of the second air swirler, and then increases toward the tip end of the passage. A third air swirler is disposed on the outside of the liquid film-forming body in an upstream portion of an annular passage which comprises as a wall surface an inner peripheral surface of the premixing tube.

In the fuel/air premixer for a gas turbine combustor according to the present invention, a flow-deflecting tubular body is employed in the form described above, and in particular, the outer diameter of the flow-deflecting tubular body, which defines the outer peripheral surface thereof, increases toward the tip end of the annular passage. Hence, by the action of the air stream which flows through the annular passage along the outer peripheral surface of the flow-deflecting tubular body, the velocity of the swirling air stream which contacts the liquid film can be increased in velocity at the tip end of the liquid film-forming body more than when simply formed into a swirl, thus improving atomization of the liquid fuel. Further, by the action of the air stream which passes through the region in the interior of the flow-deflecting tubular body at which the inner diameter has a minimum, and then passes through the region in which the inner diameter increases toward the tip end of the passage, spread of the swirling air stream in a radial direction is advanced such that the fuel particles are dispersed widely in a radial direction within the premixing tube. The fuel particles receive a centrifugal force action and are dispersed in a radial direction within the premixing tube. Then the fuel particles, having a great inertial force, penetrate the air stream that is introduced from the third air swirler so as to be dispersed and vaporized, thus forming an air/fuel mixture. By improving atomization such that the time required for vaporization of the fuel particles is shortened and dispersion of the fuel particles is advanced, an air/fuel mixture with a high degree of homogeneity can be formed over a shorter distance. As a result, the formation of NOx caused by combustion within the combustion chamber is suppressed. Further, by providing the second air swirler in the passage on the inside of the flow-deflecting tubular body, the air which flows along this passage is also formed into a swirl, and the resulting swirling air stream can be caused to spread in a radial direction along the wall surface of the flow-deflecting tubular body toward the combustion chamber. Since only air is caused to flow in the vicinity of the central axis of the premixing tube, backfiring is unlikely to occur. Even if a backfire occurs as a result of a reduction in the flow velocity of the mixture inside the premixing tube for some reason, temperature increases in the flow-deflecting tubular body caused by the backfire can be suppressed by the air stream flowing along the wall surface of the flow-deflecting tubular body.

In this fuel/air premixer, the airblast atomizer nozzle may comprise a first atomizer nozzle comprising a first liquid film-forming body, which serves as the aforementioned liquid film-forming body, having a first fuel liquid film-forming surface serving as the aforementioned tubular inner surface, and a second atomizer nozzle disposed inside of and coaxially with the flow-deflecting tubular body. The annular passage in which the first air swirler is disposed may serve as a first annular passage, and the passage in which the second air swirler is disposed may serve as a second annular passage formed between the inner peripheral surface of the flow-deflecting tubular body and the outer peripheral surface of the second atomizer nozzle. By disposing the second fuel atomizing means in the passage on the inside of the flow-deflecting tubular body, fuel can also be supplied to the air stream flowing through this passage, and a pre-mixture which is even more uniform in the radial direction can be formed, enabling a further reduction in NOx.

As regards the second atomizer nozzle, the effective passage surface area of the passage inside the flow-deflecting tubular body is typically smaller than the effective passage surface area of the outer peripheral portion of the flow-deflecting tubular body, and hence there are not many advantages to providing a new fuel supply in the inside passage of the flow-deflecting tubular body in a gas turbine that is operated under fixed conditions. The effects of providing the second atomizer nozzle are seen in cases where the parameters which affect fuel vaporization and atomization vary, such as in gas turbines having a variable engine rotation speed or gas turbines for aircraft, in which the temperature and pressure of the air introduced into the engine vary in a wide range, leading to corresponding variation in the temperature and pressure of the air that is introduced into the combustor. In such cases, it is desirable to combine fuel injection from the vicinity of the center and fuel injection from a radial position to ensure that the fuel distribution in the radial direction is as uniform as possible. When the pressure and air density are low, it is easy to disperse fuel particles in a radial direction using swirl, but when the pressure is high, the fuel particles are dispersed on the air stream, and hence if only the first fuel nozzle is used, the fuel concentration in the vicinity of the wall surface becomes excessively high at low pressure. In this case, fuel distribution in the radial direction can be made more even by injecting fuel from the second fuel nozzle alone, for example. Under low-output operating conditions, however, the air temperature is usually low, and hence suppressing the discharge of unburned components becomes more important than NOx. In such a case, fuel is preferably deflected to the vicinity of the central axis, for example, and hence fuel is preferably supplied from the second atomizer nozzle alone.

In the fuel/air premixer for a gas turbine combustor described above, the interior passage of the premixing tube may be substantially tapered. By forming the interior passage of the premixing tube in a tapered form, the flow inside the premixing tube can be increased in velocity as a whole, or in other words static pressure can be reduced toward the downstream side, preventing the occurrence of back flows on the tube wall. If back flows do not occur on the tube wall, backfiring along the vicinity of the wall surface can be suppressed.

In the fuel/air premixer for a gas turbine combustor described above, an outer tube circling the liquid film-forming body may be disposed coaxially with the liquid film-forming body, an annular gap along which an air stream flows may be formed between the inner peripheral surface of the outer tube and the outer peripheral surface of the liquid film-forming body, and a tip end of the outer tube may be positioned further forward than the tip end of the liquid film-forming body. Due to the swirl of the air stream from the third air swirler, the air stream velocity on the outer periphery increases, while the air stream velocity on the inner periphery decreases. By providing the cylindrical outer tube on the outer periphery of the liquid film-forming body and positioning the tip end of the outer tube further forward than the tip end of the liquid film-forming body, the annular passage of the third air swirler can be set in a sufficiently throttled form at the tip end portion of the liquid film-forming body. As a result, the relative velocity of the air stream which contacts the liquid film can be increased at the tip end of the liquid film-forming body, thereby advancing fuel atomization. Of course fuel particle dispersion in the radial direction is performed by the swirls produced by the first and third air swirlers.

In the fuel/air premixer for a gas turbine combustor comprising an outer tube which circles the liquid film-forming body, the liquid film-forming body may be constituted such that the outer tube and fuel atomizing means are integrated, and the third air swirler and premixing tube are integrated. Thus, by fitting or detaching the outer tube into or from the third air swirler, the fuel atomizing means can be attached to and removed from the premixing tube. This fuel/air premixer for a gas turbine combustor is constituted by two parts, namely the fuel atomizing means integrated with the outer tube, and the premixing tube integrated with the third air swirler, and hence the fuel atomizing means can be attached to the premixing tube easily. The third air swirler is integrated with the premixing tube, and hence only a comparatively small removal opening for removing the fuel atomization means integrated with the outer tube need be provided on the casing wall of the engine. This enables loads such as weight increases caused by reinforcement and the like of the periphery of the removal opening and increases in the number of processing steps to be lightened.

In the fuel/air premixer for a gas turbine combustor described above, the diameter of a tip end of the liquid film-forming surface is preferably within a range of 0.6 to 0.8 times the inner diameter of the premixing tube in an identical coaxial position to the tip end. By setting the fuel atomization diameter in this range, under the operating conditions of a typical gas turbine combustor, diffusion of the fuel vapor into the central portion of the premixing tube can be performed appropriately such that fuel does not collide with the wall surface even in cases where only the first fuel nozzle is provided. In comparison with a case where the second fuel nozzle is provided, costs can be reduced due to a reduction in the number of control devices and so on.

In the fuel/air premixer for a gas turbine combustor described above, a substantially annular fuel manifold for receiving a fuel supply may be disposed in the flow-deflecting tubular body, and a plurality of fuel injection holes connected to the fuel manifold for injecting fuel may be opened in the outer peripheral surface. By means of such a constitution, fuel is supplied to the first atomizer nozzle by injecting fuel from the fuel manifold disposed in the interior of the flow-deflecting tubular body through the simple holes formed in the outer peripheral surface. Hence the maximum thickness of the wall of the liquid film-forming body, which is greater than the diameter of the flow-deflecting tubular body, can be reduced, and the fuel nozzle can be reduced in weight and overall outer diameter.

Further, in the fuel/air premixer for a gas turbine combustor described above, a substantially annular fuel manifold may be disposed in the liquid film-forming body, and a fuel supply hole connected to the fuel manifold for causing fuel to flow onto the liquid film-forming surface may be opened in the liquid film-forming surface. The first atomizer nozzle is constituted such that the fuel manifold is provided in the interior of the liquid film-forming body, and fuel is caused to flow onto the liquid film-forming surface through the opening in the inner peripheral wall. This has the advantage of requiring only an extremely low fuel injection pressure in comparison with a jet system in which the fuel must intersect an air stream to impinge on the liquid film-forming surface. When the fuel injection pressure is low, the opening can be formed with considerably larger dimensions than that of a jet system, decreasing the likelihood of blockages in the passage.

Further, in the fuel/air premixer for a gas turbine combustor described above, a pressure swirl nozzle may be used as the second atomizer nozzle. Air stream velocity has little effect whatsoever on the atomization performance of a pressure swirl nozzle, and hence fuel distribution in the radial direction can be optimized using a simple method and in a wide range of combustor air pressures and temperatures.

Moreover, in the fuel/air premixer for a gas turbine combustor described above, the second atomizer nozzle may be an airblast atomizer nozzle comprising a fuel injection tube disposed coaxially with the central axis, having fuel injection holes opened in the outer peripheral surface thereof, a second liquid film-forming body having an annular cross section, disposed coaxially with the fuel injection tube, and a fourth air swirler disposed in a position upstream of the opening position of the fuel injection holes within an annular passage between the outer peripheral surface of the fuel injection tube and the liquid film-forming surface of the second liquid film-forming body, in which fuel is injected from the fuel injection holes toward the liquid film-forming surface of the second liquid film-forming body. When the second atomizer nozzle is constituted in this manner, the fuel jet that is ejected radially from the fuel injection holes formed in the outer peripheral surface of the fuel injection tube impinges on the liquid film-forming surface of the second liquid film-forming body to form a liquid film on the liquid film-forming surface. The air stream which flows along the annular passage between the outer peripheral surface of the fuel injection tube and the liquid film-forming surface of the second liquid film-forming body is formed into a swirl by the fourth air swirler, and the liquid film is atomized by this swirling air stream. With this system, the fuel manifold provided on the fuel injection tube side and the second liquid film-forming body provided on the outside the fuel injection tube can be constituted as separate components, and hence a simple tube suffices as the fuel manifold, making the fuel injection holes extremely easy to form, and the outer form of the atomizer nozzle can be reduced in size to approximately that of a pressure swirl nozzle.

In the fuel/air premixer for a gas turbine combustor described above, the direction of the swirls that are applied to the air streams by the first and second air swirlers may be opposite to each other. By making the swirl direction of the first and second air swirlers, which are adjacent in the vicinity of the central axis, opposite to each other, the swirl can be negated over a short distance in the vicinity of the central axis, dramatically suppressing the occurrence of back flows. Hence backfiring is suppressed when fuel is injected from the second fuel nozzle within the second air swirler passage, and even if a backfire does occur due to a dramatic reduction in the flow velocity of the mixture, the flame is securely discharged downstream when the mixture velocity returns to normal. As a result, situations in which the fuel is blocked and the engine must be stopped can be avoided.

In the fuel/air premixer for a gas turbine combustor described above, the direction of the swirls that are applied to the air streams by the second and fourth air swirlers may be opposite to each other. By making the swirl direction of these air swirlers, which are adjacent closest to the central axis, opposite to each other, the swirl of the pre-mixture can be negated over a short distance, dramatically suppressing the occurrence of back flows. Hence backfiring is suppressed when fuel is injected from the second fuel nozzle within the second air swirler passage, and even if a backfire does occur due to a dramatic reduction in the flow velocity of the mixture, the flame is securely discharged downstream when the mixture velocity returns to normal. As a result, situations in which the fuel is blocked and the engine must be stopped can be avoided.

DESCRIPTION OF THE PREFERRED EMBODIMENTS

Figure 1:
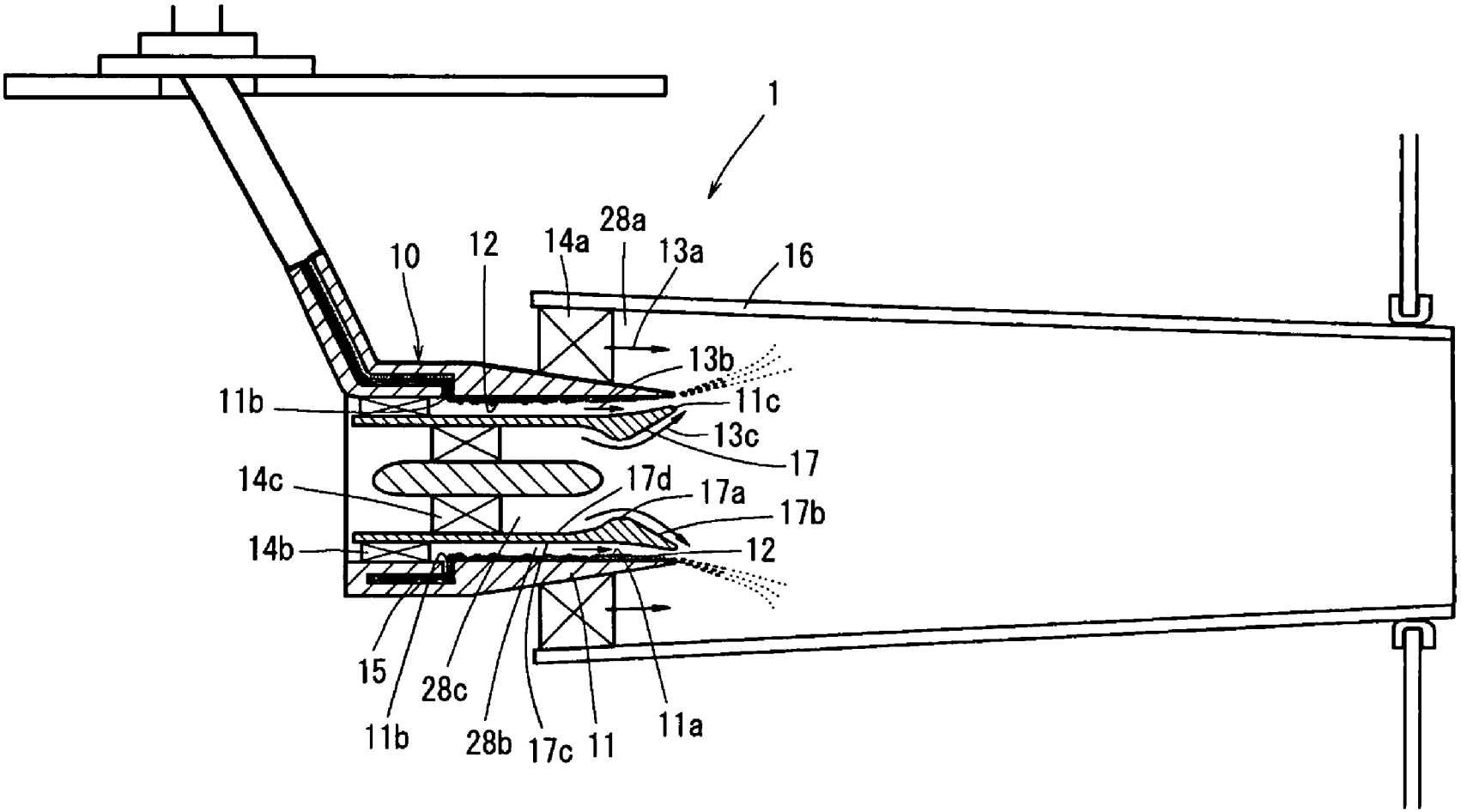
FIG. 1 is a longitudinal sectional view showing a first embodiment of a fuel/air premixer for a gas turbine according to the present invention.

FIG. 1 is a longitudinal sectional view showing a first embodiment of a fuel/air premixer for a gas turbine combustor according to the present invention. In a fuel/air premixer 1 for a gas turbine combustor shown in FIG. 1, an airblast atomizer nozzle 10 is provided as fuel atomizing means at an inlet portion to a tubular premixing tube 16. A flow-deflecting tubular body 17 having an annular cross section is disposed on the inside of and coaxially with a liquid film-forming body 11 of the airblast atomizer nozzle 10. A first air swirler 14*b* is disposed at an upstream portion of a first annular passage 28*b* between an outer peripheral surface 17*c* of the flow-deflecting tubular body 17 and a liquid film-forming surface 11*a* of the liquid film-forming body 11, and a second air swirler 14*c* is disposed at an upstream portion of a second annular passage 28*c* having as a wall surface an inner peripheral surface 17*d* of the flow-deflecting tubular body 17. The flow-deflecting tubular body 17 is a tubular body with an inner peripheral surface and an outer peripheral surface, the inner diameter and outer diameter of which are fixed substantially along the entire length of the airblast atomizer nozzle 10 excluding the tip end portion. At the tip end portion, the outer diameter, which defines the outer peripheral surface 17*c*, increases toward the tip end of the passage, and the inner diameter, which defines the inner peripheral surface 17*d*, first contracts gently downstream of the downstream end of the second air swirler 14*c* to have a minimum, and then increases toward the tip end to form a wall surface 17*b*. The outer diameter increases smoothly and gently, but the inner diameter increases more rapidly than the outer diameter downstream of the position at which the inner diameter has a minimum, and hence at the tip end side of the passage, the inner diameter substantially catches up with the outer diameter, thus forming a tip. Note that the gas turbine fuel/air premixer 1 is constituted to be point symmetrical about a central axis, as are each of the gas turbine fuel/air premixers 2 to 5 to be described below. In FIG. 1 as well as other drawings, the liquid film-forming surface 11*a* is depicted as a right circular tube face, but may have a tapered surface which enlarges smoothly toward the downstream side. Further, to simplify the drawing, the line linking the upper and lower end edges on the tip end side has been omitted.

Fuel flows from a substantially annular fuel manifold 15 in the interior of the liquid film-forming body 11 through an opening 11*b* onto the liquid film-forming surface 11*a* to form a liquid film 12. The fuel from the fuel manifold 15 may be caused to flow onto the liquid film-forming surface 11*a* by inclining the opening 11*b* tangentially to the liquid film-forming surface 11*a* to form a swirl, or may be introduced in an axial direction, or in a swirl, from an annular slit between the fuel manifold 15 and the liquid film-forming surface 11*a*. The liquid film 12 flows into a free space of the premixing tube 16 from a tip end 11*c* of the liquid film-forming surface, and is atomized mainly by an air stream 13*b* flowing along a first annular passage 28*b*. An air stream 13*a* flowing along a third annular passage 28*a* formed between the inside of the premixing tube 16 and the outside of the liquid film-forming body 11 contributes to fuel atomization secondarily, but its main role is to prevent the liquid film 12 from moving round to the back surface of the liquid film-forming body 11. If the liquid film 12 does move round, then the thickness thereof increases, making breakup of the liquid film less successful and creating large drops of liquid.

A third air swirler 14*a* is disposed at an upstream portion of the third annular passage 28*a*. The air streams 13*a*, 13*b* are respectively formed into swirls by the third air swirler 14*a* and first air swirler 14*b*, which are constituted by swirl vanes. The air stream 13*b* spreads in a radial direction downstream of the tip end 11*c* of the liquid film-forming surface 11*a*, and the fuel particles join this air stream so as to be mixed with the air stream 13*a*, whereupon the mixture is dispersed into the interior of the premixing tube 16. When formed into a swirl, the flow velocity increases toward the layer nearest to the liquid film-forming surface 11*a*, and at the tip end 11*c* of the liquid film-forming surface 11*a*, the velocity of the air stream contacting the liquid film 12 also increases, which is extremely effective in advancing atomization. Compared with a case in which the outer peripheral surface 17*c* of the flow-deflecting tubular body 17 does not expand radially at the tip end portion, spread of the air stream 13*b* in the radial direction is advanced, which is effective in dispersing the fuel particles throughout the air stream 13*a* quickly.

The flow-deflecting tubular body 17 expands in a radial direction at the tip end portion of the outer peripheral surface 17*c* such that the air stream 13*b* increases in velocity at the tip end of the liquid film-forming surface 11*a*. Meanwhile, the air stream 13*c* formed into a swirl by the second air swirler 14*c* is throttled at the contracted portion 17*a* of the flow-deflecting tubular body 17 where the inner diameter thereof has a minimum. Having passed through the contracted portion 17*a*, however, the air stream 13*c* spreads along the expanding wall surface 17*b* of the inner peripheral surface 17*d* in order to be formed into a swirl. In cases where the flame inside the premixing tube 16 backfires, the air stream 13*c* is effective not only in removing the radiation heat of the flame from the flow-deflecting tubular body 17, but also in preventing the flow-deflecting tubular body 17 from being directly exposed to the flame. If a swirl cannot be formed, the air stream 13*c* is unable to flow along the wall surface 17*b*, and instead flows forward in a jet. As a result, the air stream 13*c* is unable to protect the wall surface 17*b* from the flame. Note that if the expanding wall surface 17*b* of the flow-deflecting tubular body 17 widens too sharply, the air stream 13*c* is unable to cover the wall surface 17*b* completely even if the swirl is strong.

Figure 2:
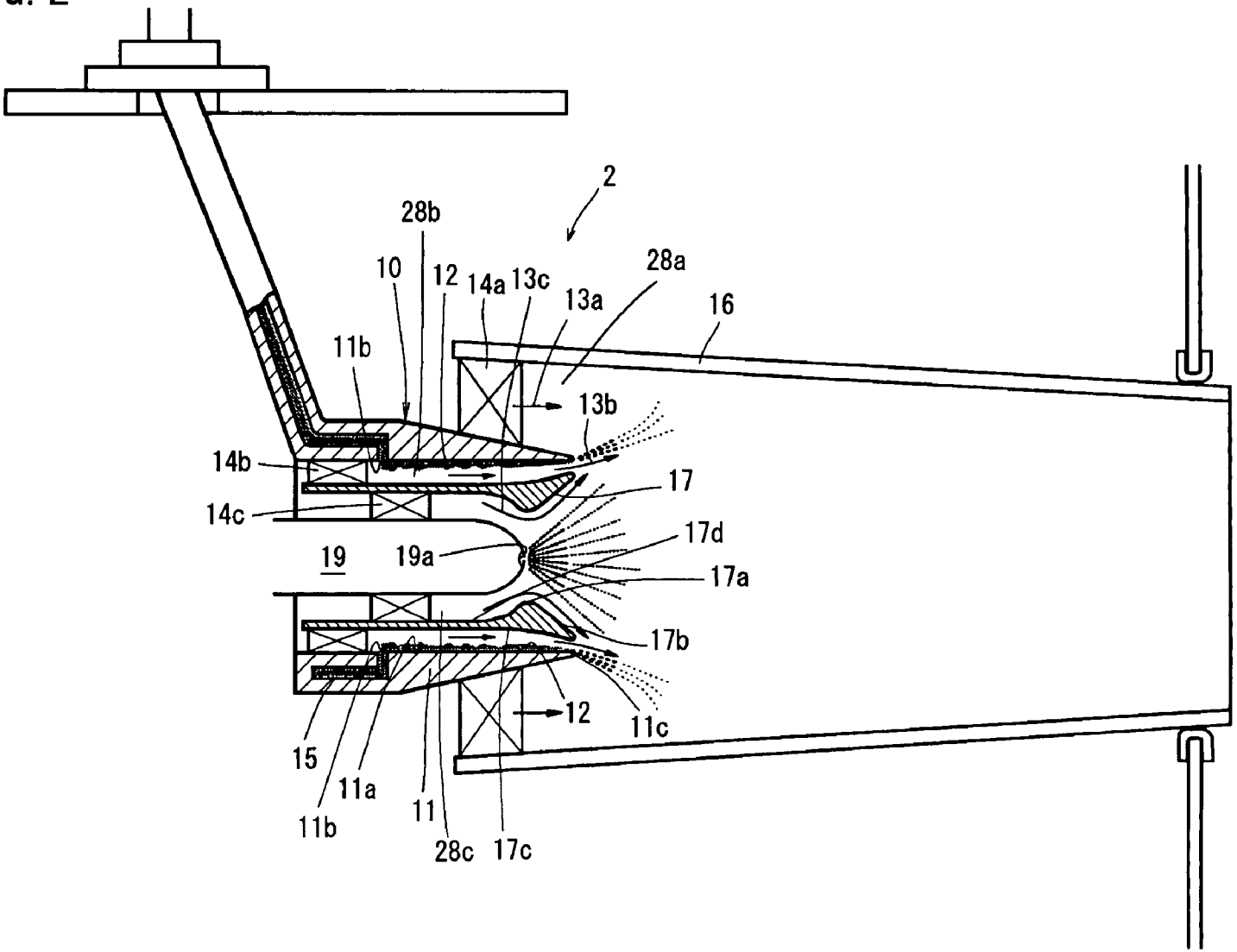
FIG. 2 is a longitudinal sectional view showing a second embodiment of a fuel/air premixer for a gas turbine according to the present invention.

FIG. 2 is a longitudinal sectional view showing a second embodiment of a gas turbine fuel/air premixer according to the present invention. In a gas turbine fuel/air premixer 2 shown in FIG. 2, identical reference symbols have been allocated to the main constitutional elements and sites exhibiting similar functions to the gas turbine fuel nozzle 1 shown in FIG. 1, and hence repeated description thereof has been omitted. The gas turbine fuel/air premixer 2 comprises an airblast atomizer nozzle 10 having a liquid film-forming body 11, a pressure swirl nozzle 19 serving as an atomizer nozzle disposed coaxially with and on the inside of the airblast atomizer nozzle 10, and a flow-deflecting tubular body 17 disposed between the liquid film-forming body 11 and pressure swirl nozzle 19. The actions and effects of the flow-deflecting tubular body 17 regarding improvements in the atomization performance of the airblast atomizer nozzle 10 duplicate those of the first embodiment, and hence description thereof has been omitted.

The gas turbine fuel/air premixer 2 employs the pressure swirl nozzle 19 to exhibit the following actions and effects. An air stream 13*c* which flows along an annular passage between the flow-deflecting tubular body 17 and the pressure swirl nozzle 19 is bent in a central axial direction by a contracted portion 17*a* provided in the flow-deflecting tubular body 17, and thus flows along the surface of the pressure swirl nozzle 19. By appropriately setting the axial distance between the contracted portion 17*a* and a fuel injection hole 19*a* formed in the tip end portion of the pressure swirl nozzle 19, and appropriately varying the inner diameter of the flow-deflecting tubular body 17, which defines an inner peripheral surface 17*d* thereof, before and after the contracted portion 17*a*, interference between the air stream 13*c* and the fuel mist from the pressure swirl nozzle 19 can be strengthened, thereby advancing mixing of the fuel mist and air. Moreover, radial spread of the pre-mixture of fuel mist and air can be adjusted according to the strength of the swirl.

Figure 3:
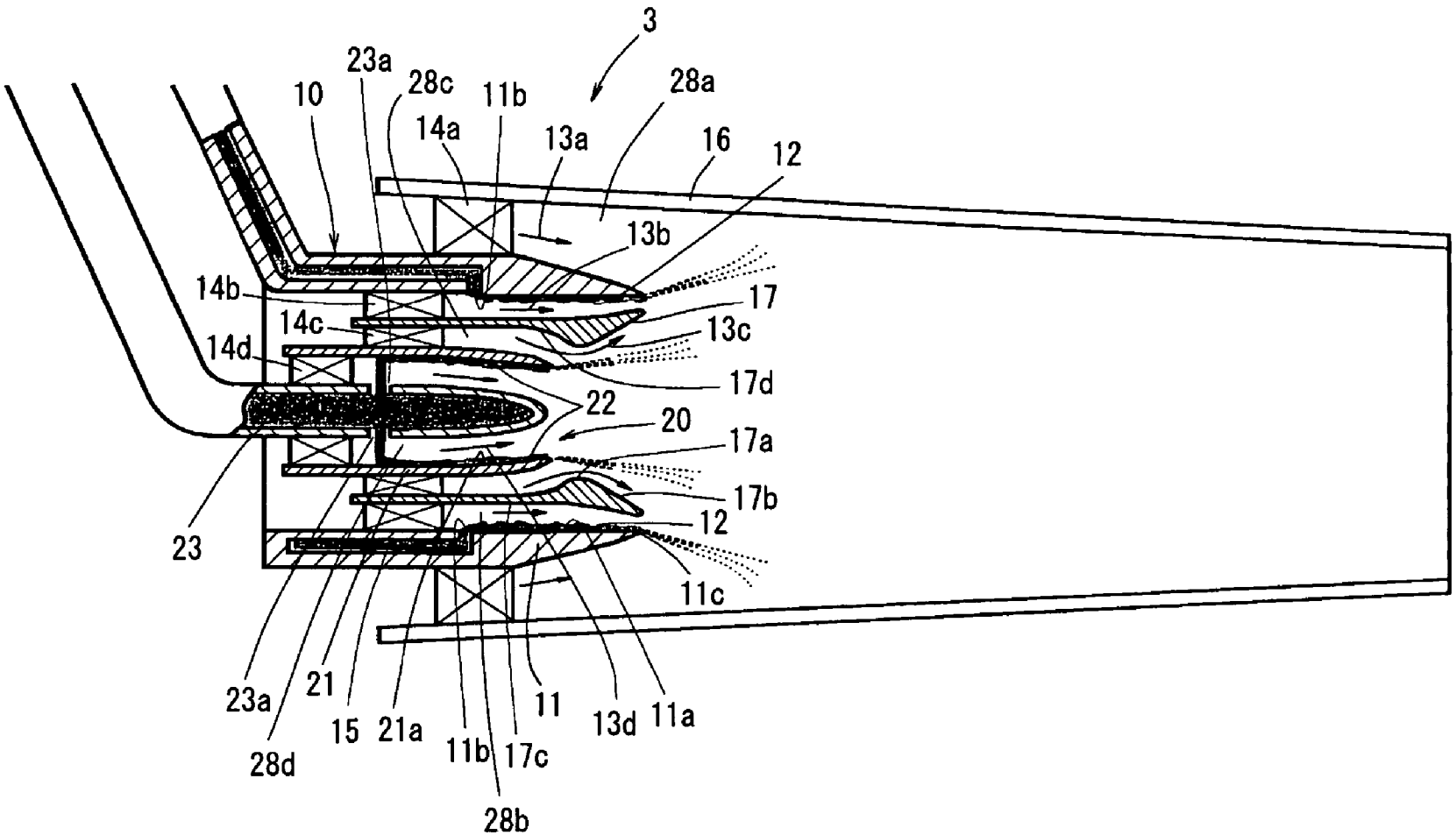
FIG. 3 is a longitudinal sectional view showing a third embodiment of a fuel/air premixer for a gas turbine according to the present invention.

FIG. 3 is a longitudinal sectional view showing a third embodiment of the gas turbine fuel/air premixer according to the present invention. In a gas turbine fuel/air premixer 3 shown in FIG. 3, identical reference symbols have been allocated to the main constitutional elements and sites exhibiting similar functions to the gas turbine fuel/air premixers 1, 2 shown in FIGS. 1 and 2, and hence repeated description thereof has been omitted. The gas turbine fuel nozzle 3 comprises an airblast atomizer nozzle 10 serving as a first atomizer nozzle having a liquid film-forming body 11, an airblast atomizer nozzle 20 serving as a second atomizer nozzle disposed coaxially with and on the inside of the airblast atomizer nozzle 10, and a flow-deflecting tubular body 17 disposed between the liquid film-forming body 11 and airblast atomizer nozzle 20. The actions and effects of the flow-deflecting tubular body 17 regarding improvements in the atomization performance of the airblast atomizer nozzle 10 duplicate those of the first and second embodiments, and hence description thereof has been omitted.

The airblast atomizer nozzle 20 comprises a fuel injection tube 23 disposed coaxially with the central axis, a liquid film-forming body 21 having an annular cross section, which is disposed coaxially with the airblast atomizer nozzle 20, and a fourth air swirler 14*d* disposed on an upstream portion of a passage between the outer peripheral surface of the fuel injection tube 23 and a liquid film-forming surface 21*a* of the liquid film-forming body 21. Fuel is injected radially from fuel injection holes 23*a*, which opens on the outer peripheral surface of the fuel injection tube 23, toward the liquid film-forming surface 21*a* of the liquid film-forming body 21, and impinges on the liquid film-forming surface 21*a* of the liquid film-forming body 21 to form a liquid film 22. Having formed the liquid film 22, the fuel is atomized by an air stream 13*d* flowing along a passage between the fuel injection tube 23 and the liquid film-forming body 21 at the tip end of the liquid film-forming surface 21*a*. The flow-deflecting tubular body 17 guides an air stream 13*c*, which flows along the inside thereof, to flow along the outer peripheral surface of the liquid film-forming body 21 as closely as possible, and thus ensures that the liquid film 22 is atomized effectively by the air stream 13*d* flowing along a fourth annular passage 28*d*.

Figure 4:
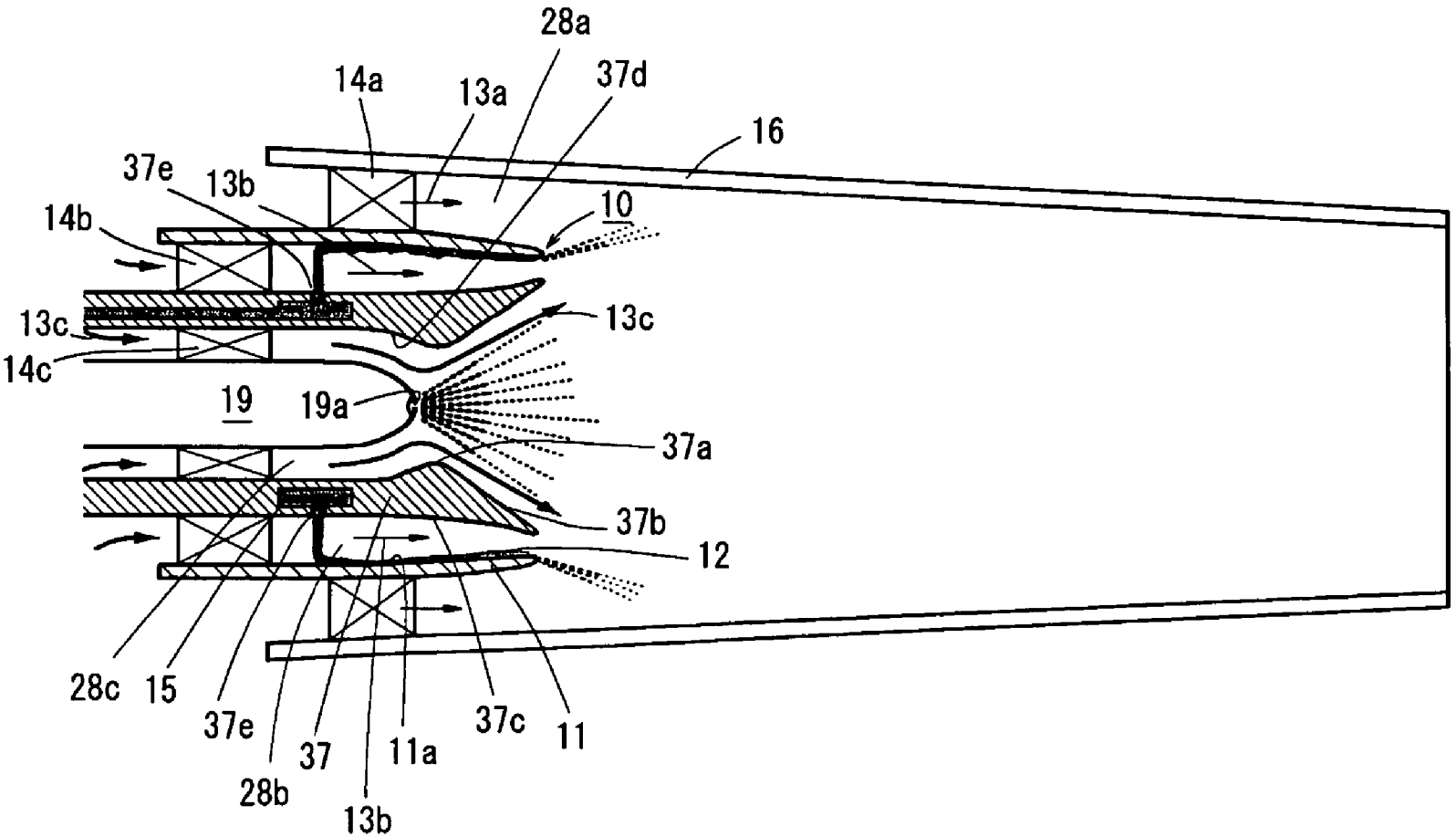
FIG. 4 is a longitudinal sectional view showing a fourth embodiment of a fuel/air premixer for a gas turbine according to the present invention.

FIG. 4 is a longitudinal sectional view showing a fourth embodiment of the gas turbine fuel/air premixer according to the present invention. A gas turbine fuel/air premixer 4 shown in FIG. 4 differs from the gas turbine fuel/air premixer 2 illustrated in FIG. 2 as the second embodiment in that a fuel manifold 15 is provided in the airblast atomizer nozzle 10 in the interior of the wall of a flow-deflecting tubular body 37. In FIG. 4, identical reference symbols have been allocated to the main constitutional elements and sites exhibiting similar functions to the gas turbine fuel/air premixer 2, and hence repeated description thereof has been omitted. The flow-deflecting tubular body 37 comprises a contracted portion 37*a*, an expanding wall surface 37*b*, an outer peripheral surface 37*c*, and an inner peripheral surface 37*d*, and is formed thickly in order to accommodate the fuel manifold 15 in its interior. Fuel is injected radially from fuel injection holes 37*e* which is connected to the manifold 15 of the flow-deflecting tubular body 37 and opens on the wall of the outer peripheral surface 37*c*, where upon the fuel impinges on a liquid film-forming surface 11*a* of a liquid film-forming body 11 to form a liquid film 12. The fuel is then atomized by an air stream 13*b* at the tip end of the liquid film 12.

Figure 5:
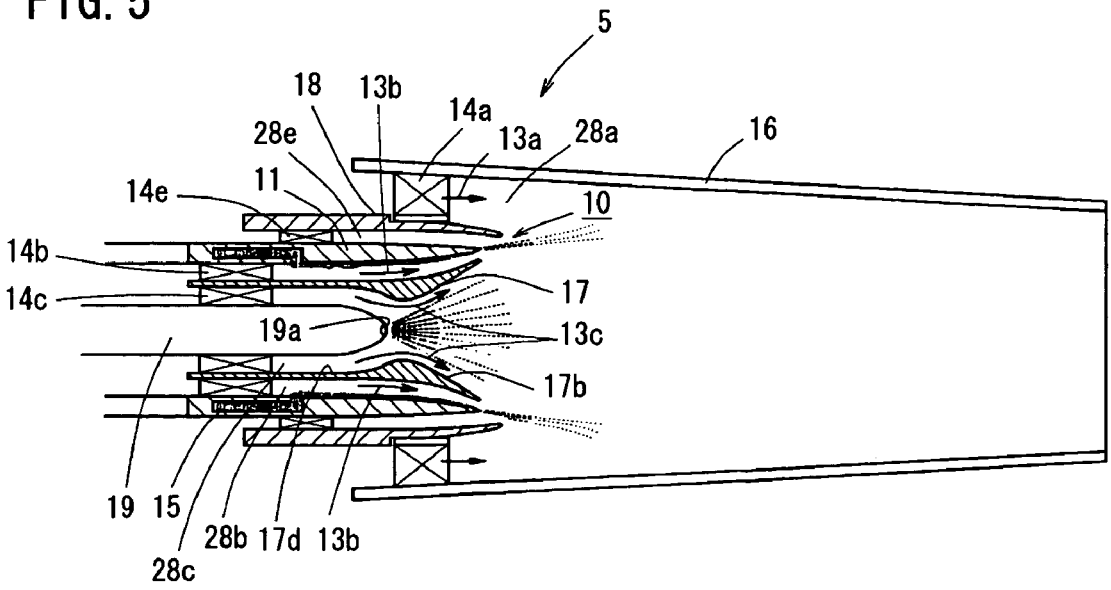
FIG. 5 is a longitudinal sectional view showing a fifth embodiment of a fuel/air premixer for a gas turbine according to the present invention.
Figure 6:
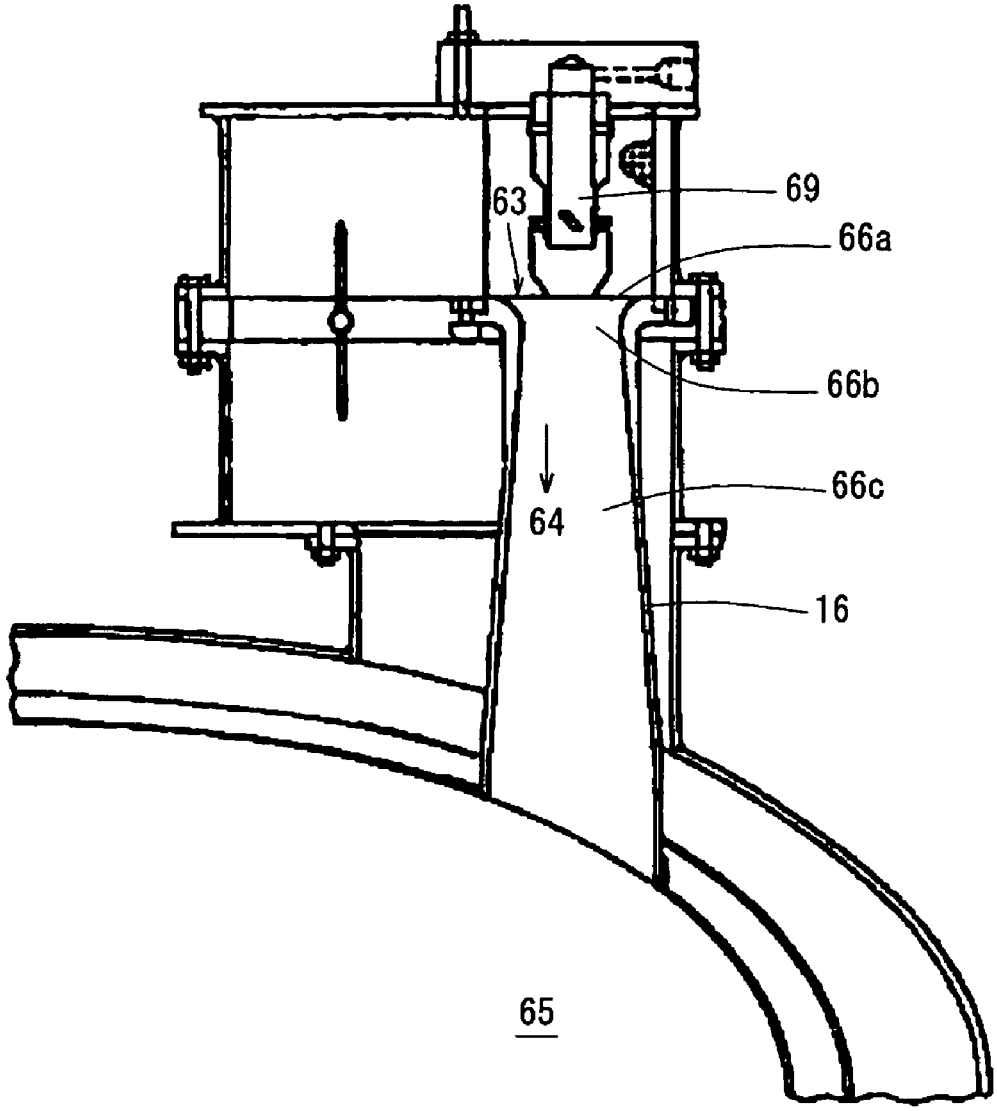
FIG. 6 Prior Art
FIG. 6 is a longitudinal sectional view showing a representative example of a conventional fuel/air premixer for a gas turbine using a liquid film-type airblast atomizer nozzle.
Figure 7:
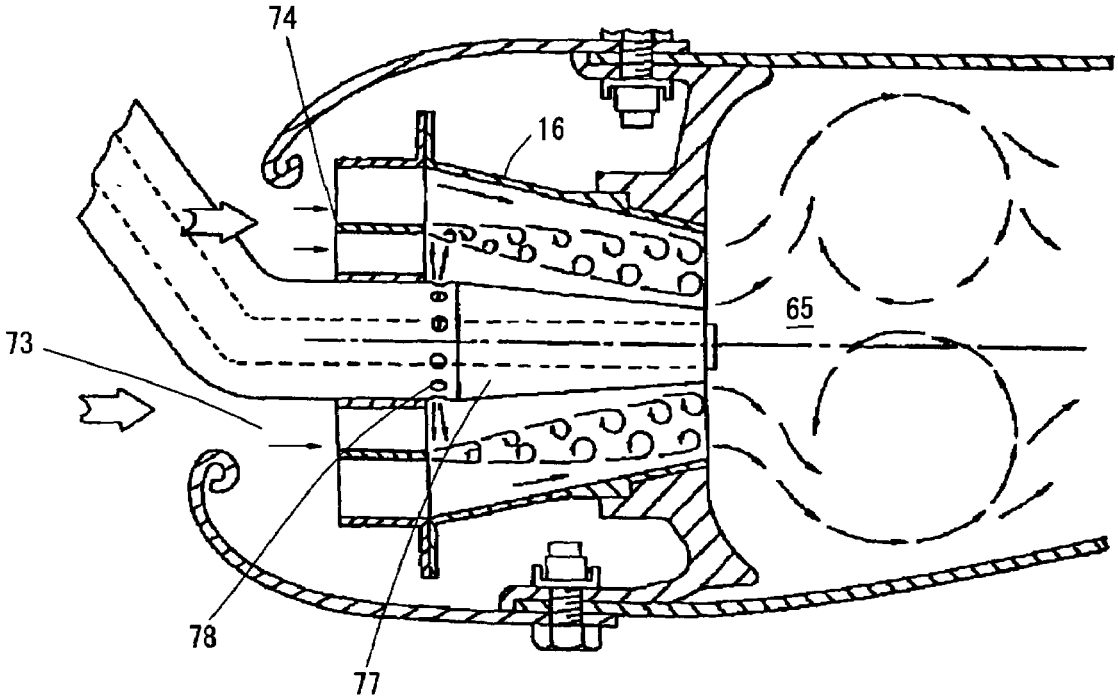
FIG. 7 Prior Art
FIG. 7 is a longitudinal sectional view showing an example of a conventional combined fuel nozzle combining a liquid film-type airblast atomizer fuel nozzle and a pressure swirl nozzle.

FIG. 5 is a longitudinal sectional view showing a fifth embodiment of the gas turbine fuel/air premixer according to the present invention. A gas turbine fuel/air premixer 5 shown in FIG. 5 differs from the gas turbine fuel/air premixer 2 illustrated in FIG. 2 as the second embodiment in that an outer tube 18 is disposed in the airblast atomizer nozzle 10 coaxially with and on the outer periphery of a liquid film-forming body 11, and an annular passage 28*e* is formed so as to be defined by the outer peripheral surface of the liquid film-forming body 11 and the inner peripheral surface of the outer tube 18. In FIG. 5, identical reference symbols have been allocated to the main constitutional elements and sites exhibiting similar functions to the gas turbine fuel/air premixer 2, and hence repeated description thereof has been omitted. The outer tube 18 is connected to the outer peripheral surface of the liquid film-forming body 11 upstream of the annular passage 28*e* by a plurality of struts arranged in a circumferential direction or by a swirl vane 14*e*. The fuel nozzle assembly, which is constituted by the airblast atomizer nozzle 10 disposed on the inside of the outer tube and a pressure swirl nozzle 19 serving as a second fuel nozzle, is formed as an integral body and inserted into a third air swirler 14*a* which is supported on the inner wall surface of the premixing tube 16. By means of such a constitution, the fuel nozzle assembly can be separated from the premixing tube 16, and as a result, the fuel nozzle assembly can be attached and removed similarly to a fuel nozzle in a gas turbine which does not comprise the premixing tube 16, thereby facilitating maintenance and inspections.

The fuel/air premixer for a gas turbine combustor according to the present invention can be used not only in gas turbine combustors for use in power generators and aircraft, but also in other continuous combustion devices using liquid fuel.

What is claimed is:

1. A fuel/air premixer for a gas turbine combustor, wherein:

an airblast atomizer nozzle comprising a liquid film-forming body, a tubular inner surface of which serves as a fuel liquid film-forming surface, is disposed at an inlet portion to a tubular premixing tube as fuel atomizing means;

a flow-deflecting tubular body having an annular cross section is disposed on the inside of and coaxially with said liquid film-forming body;

a first air swirler is disposed in an upstream portion of an annular passage formed between an outer peripheral surface of said flow-deflecting tubular body and said liquid film-forming surface of said liquid film-forming body;

a second air swirler is disposed in an upstream portion of a passage which comprises as a wall surface an inner peripheral surface of said flow-deflecting tubular body, said flow-deflecting tubular body takes a form in which an outer diameter defining said outer peripheral surface increases toward a tip end of said annular passage, and an inner diameter defining said inner peripheral surface has a minimum downstream of a downstream end of said second air swirler, and then increases toward the tip end of said passage; and a third air swirler is disposed on the outside of said liquid film-forming body in an upstream portion of an annular passage which comprises as a wall surface an inner peripheral surface of said premixing tube.

2. The fuel/air premixer for a gas turbine combustor according to claim 1, wherein said airblast atomizer nozzle comprises:

a first atomizer nozzle comprising a first liquid film-forming body, which serves as said liquid film-forming body, having a first fuel liquid film-forming surface serving as said tubular inner surface; and a second atomizer nozzle disposed inside of and coaxially with said flow-deflecting tubular body, said annular passage in which said first air swirler is disposed serving as a first annular passage, and said passage in which said second air swirler is disposed serving as a second annular passage formed between the inner peripheral surface of said flow-deflecting tubular body and the outer peripheral surface of said second atomizer nozzle.

3. The fuel/air premixer for a gas turbine combustor according to claim 1 or 2, wherein said premixing tube is substantially tapered.

4. The fuel/air premixer for a gas turbine combustor according to claim 1 or 2, wherein the diameter of a tip end of said liquid film-forming surface is within a range of 0.6 to 0.8 times the inner diameter of said premixing tube in an identical coaxial position to said tip end.

5. The fuel/air premixer for a gas turbine combustor according to claim 1 or 2, wherein a substantially annular fuel manifold for receiving a fuel supply is disposed in said flow-deflecting tubular body, and a plurality of fuel injection holes connected to said fuel manifold for injecting fuel are opened in the outer peripheral surface of said flow-deflecting tubular body.

6. The fuel/air premixer for a gas turbine combustor according to claim 1 or 2, wherein a substantially annular fuel manifold is disposed in said liquid film-forming body, and a plurality of fuel supply holes connected to said fuel manifold for causing fuel to flow onto said liquid film-forming surface is opened in said liquid film-forming surface.

7. The fuel/air premixer for a gas turbine combustor according to claim 2, wherein said second atomizer nozzle is an airblast atomizer nozzle comprising:

a fuel injection tube disposed coaxially with the central axis, having a plurality of fuel injection holes opened in the outer peripheral surface thereof;

a second liquid film-forming body having an annular cross section, disposed coaxially with said fuel injection tube; and a fourth air swirler disposed in a position upstream of the opening position of said fuel injection holes within an annular passage formed between the outer peripheral surface of said fuel injection tube and the liquid film-forming surface of said second liquid film-forming body, fuel being injected from said fuel injection holes toward the liquid film-forming surface of said second liquid film-forming body.

8. The fuel/air premixer for a gas turbine combustor according to claim 1 or 2, wherein the directions of the swirls that are applied to air streams by said first air swirler and said second air swirler are opposite to each other.

9. The fuel/air premixer for a gas turbine combustor according to claim 7, wherein the directions of the swirls that are applied to air streams by said second air swirler and said fourth air swirler are opposite to each other.

* * * * *